US008997758B1

(12) United States Patent
Davenport

(10) Patent No.: US 8,997,758 B1
(45) Date of Patent: Apr. 7, 2015

(54) HAIR PROTECTION, RETENTION, AND STYLING APPARATUS

(71) Applicant: Dale Davenport, Westminster, CO (US)

(72) Inventor: Dale Davenport, Westminster, CO (US)

( * ) Notice: Subject to any disclaimer, the term of this patent is extended or adjusted under 35 U.S.C. 154(b) by 0 days.

(21) Appl. No.: 14/049,177

(22) Filed: Oct. 8, 2013

(51) Int. Cl.

| | |
|---|---|
| ***A45D 7/00*** | (2006.01) |
| ***A45D 2/20*** | (2006.01) |
| ***A45D 2/18*** | (2006.01) |
| ***A45D 8/00*** | (2006.01) |
| ***A45D 8/36*** | (2006.01) |
| ***A45D 2/12*** | (2006.01) |

(52) U.S. Cl.
CPC .. *A45D 8/36* (2013.01); *A45D 2/18* (2013.01); *A45D 2/12* (2013.01); *A45D 2/125* (2013.01); *A45D 2/127* (2013.01); *A45D 8/00* (2013.01); *A45D 2007/002* (2013.01)

(58) Field of Classification Search
CPC ..... A45D 2/12; A45D 2/122; A45D 2/20; A45D 2/125; A45D 2/127; A45D 2/14; A45D 2/18; A45D 2007/002; A45D 2007/004; A45D 2007/001; A45D 8/00; A45D 8/34; A45D 8/36; A45D 8/40; A45D 7/00
USPC ..... 132/247, 200, 212, 222, 245, 246, 248, 132/273, 275, 278, 55, 274, 210, 253, 254, 132/54, 270; 2/171, 171.5, 171.8, 172, 2/181.6, 181.8, 182.3, 204, 207, 174, 2/DIG. 11; D2/865, 877, 881; 54/78; 119/850, 856, 857, 600, 607; D28/10, D28/39, 41
See application file for complete search history.

(56) References Cited

U.S. PATENT DOCUMENTS

| | | | | | |
|---|---|---|---|---|---|
| 1,564,923 | A | * | 12/1925 | Ackerman | 132/246 |
| 1,612,911 | A | * | 1/1927 | Durnerin | 132/246 |
| 2,166,386 | A | * | 7/1939 | Auster | 132/246 |
| 2,524,266 | A | * | 10/1950 | Licastro | 132/246 |
| 2,649,097 | A | * | 8/1953 | Chernack | 132/246 |
| 5,411,040 | A | * | 5/1995 | Forrest | 132/211 |
| 5,494,059 | A | * | 2/1996 | Barrows et al. | 132/273 |
| 5,694,750 | A | * | 12/1997 | Allen | 54/78 |
| 5,727,575 | A | * | 3/1998 | Rontal | 132/200 |
| 5,988,183 | A | * | 11/1999 | Huang | 132/273 |
| 2011/0168203 | A1 | * | 7/2011 | Ivanov | 132/211 |

* cited by examiner

*Primary Examiner* — Vanitha Elgart

(57) ABSTRACT

A hair protection, retention and styling apparatus has a triangular shape. The left and right base corners comprise hair protection flaps that extend from either side of a rectangular hair retention channel roll. A top hair retention flap extends from the top thereof to form the top corner. A cylindrical style bar is attached near the top of the triangular body. Once a user places her hair on the channel roll, the hair protection flaps are folded in over the hair, thereby containing, retaining, and protecting the hair. The ends of the user's hair are wrapped around the style bar and the top hair retention roll is wrapped over the bar and the hair and bar are rolled approximately to the user's scalp. First and second wrap ties attach near the top of the triangular body and are used to secure the apparatus to the user's head.

16 Claims, 9 Drawing Sheets

HAIR PROTECTION, RETENTION, AND STYLING APPARATUS

TECHNICAL FIELD

The present invention relates generally to the field of hair care; and, more particularly, to a hair protection, retention and styling apparatus.

BACKGROUND

Long hair can be beautiful and flattering, but it can also require large amounts of time and effort to maintain and protect that hair. This becomes especially true whenever a person with long hair engages in sports and related activities (such as riding an ATV, motorcycle, etc.) in which the hair needs to be protected and restrained. There are many methods of doing this, including using hair-nets, pins, pony-tails, buns, etc.

A hair bun or bobtail is a type of hairstyle that can be at once utilitarian as well as flattering. There are many varieties, but they all have the basics in common: the hair is pulled back from the face and formed into a generally circular coil on the back of the head or neck. The style has been in use for centuries: early drawings and paintings depict hair buns, and they are especially common in the ancient Japanese and Chinese cultural histories. There are many varieties incorporating braiding, twisting, coiling and other time-consuming construction methodologies.

Not all hair bun styles and methods of constructing them are time-consuming; in fact, there are various devices known in the art for making buns that help to simplify the process. However, one of the primary problems with prior art hair buns is that when the hair is removed from the bun, the person is left with band kinks, crushed ends and rats' nests. Furthermore, the buns often destroy or degrade prior hair-styling efforts, remove curls, reduce body, etc. Curlers and stylers are designed only for curling and styling, few would want to be seen in public wearing such devices. What is needed is a hair protection, retention and styling apparatus that is quick and easy to put in and take out, does not damage the hair, and also adds great body and soft curls and looks good while worn.

SUMMARY

One embodiment of the present invention comprises a hair protection, retention and styling apparatus having a generally triangular shape when placed flat on a table or similar surface and viewed from above. The left and right base corners of the triangle comprise left and right hair protection flaps that extend from the main body of the apparatus. To use the apparatus, a person with relatively long hair gathers her hair near her scalp using her hands into a pony tail type arrangement. The user then bends down over the apparatus and places the end of the pony tail near the top corner of the apparatus. Once the hair is resting on the hair protection, retention and styling apparatus, the hair protection flaps are folded in, thereby containing, retaining, and protecting the hair. It is preferable that the corners of the triangle be significantly rounded rather than pointed.

A relatively long, generally rectangular member is attached to the main body above the protection flaps. The member is laid flat extending across the top corner of the apparatus, and the center section of the member is overlaid with a padded material, such as a piece of quilt batting, generally three to ten inches long (preferably about seven inches, but can be any length), before the member is rolled into the shape of a padded cylinder. The cylinder is about one half to two inches in diameter, preferably approximately three quarter inches (but can be almost any size). The cylinder forms a style bar that is attached a few inches down from the top of the triangular body (between zero and six inches down, preferably about 4 inches), and across the top corner, approximately parallel to the base of the triangle.

The user's hair is wrapped around the style bar and the user also rolls the top corner around it as well. Then the bar continues to be rolled until the resulting roll reaches approximately to the user's scalp (near the base of the original pony tail). The loose ends of the generally rectangular member comprise left and right wrap ties and are then used to secure the apparatus to the user's head.

DETAILED DESCRIPTION

Figure 1:
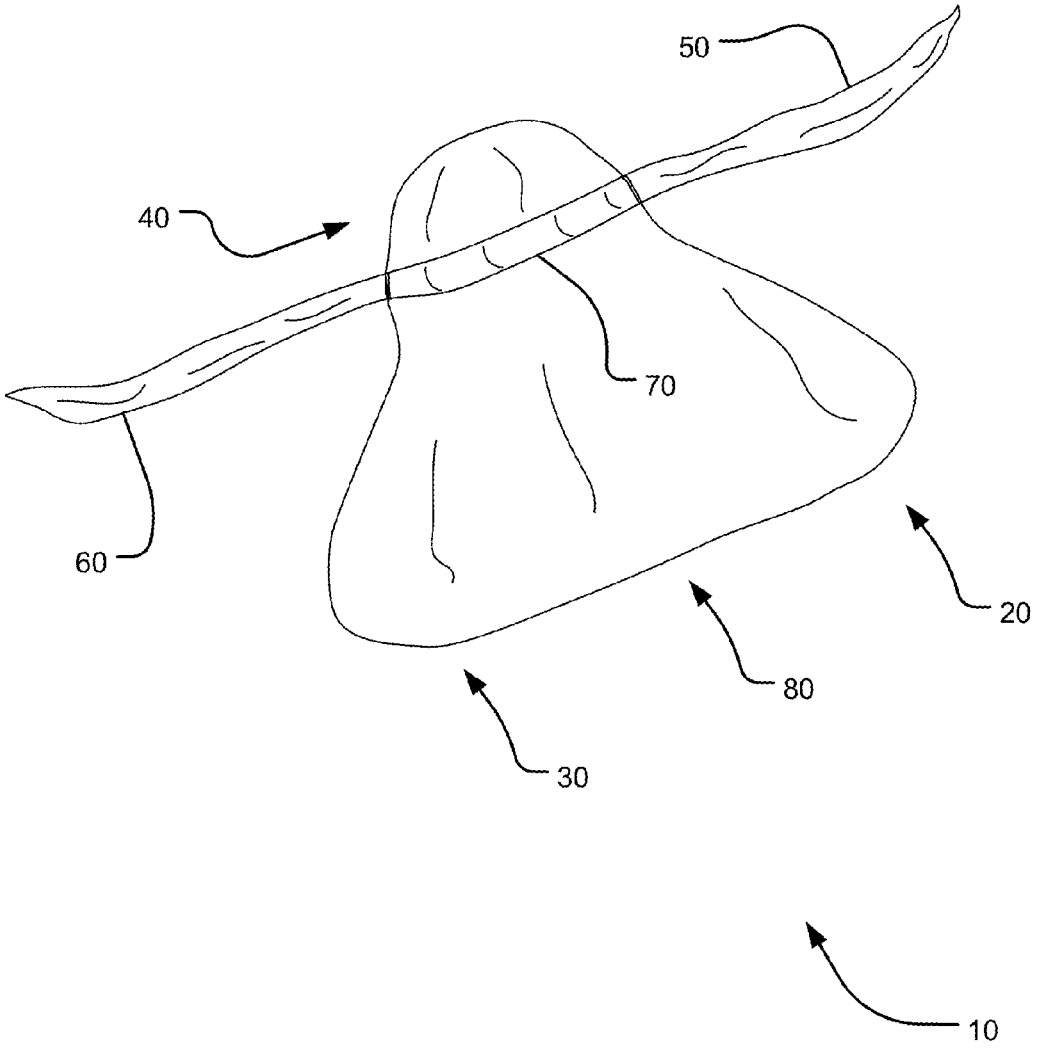
FIG. 1 illustrates a top perspective view of an exemplary embodiment of a hair protection, retention and styling apparatus.

In the following discussion, numerous specific details are set forth to provide a thorough understanding of the present disclosure. However, those skilled in the art will appreciate that embodiments may be practiced without such specific details. Furthermore, lists and/or examples are often provided and should be interpreted as exemplary only and in no way limiting embodiments to only those examples.

Exemplary embodiments are described below in the accompanying Figures. The following detailed description provides a comprehensive review of the drawing Figures in order to provide a thorough understanding of, and an enabling description for, these embodiments. One having ordinary skill in the art will understand that in some cases well-known structures and functions have not been shown or described in detail to avoid unnecessarily obscuring the description of the embodiments.

The hair protection, retention and styling apparatus has a generally triangular shape when placed flat on a table or similar surface and viewed from above. The left and right corners of the triangle comprise left and right hair protection flaps that extend from the main body of the apparatus. The hair protection flaps are folded in once the user places his or her hair on the apparatus, thereby containing, retaining, and protecting the hair. A relatively long, generally rectangular member (preferably 25-35 inches long and 1-10 inches, preferably 5, high, but may be other dimensions) is attached to the main body above the protection flaps. The member is laid flat and the center section is first overlaid with a padded material, such as a piece of quilt batting, three to ten inches long (preferably about seven), before the member is rolled into the shape of a padded cylinder. The cylinder is about one half to two inches in diameter, preferably approximately three quarter inches. The cylinder forms a style bar that is attached a few inches down from the top of the triangular body (between zero and six inches down, preferably about 4 inches). The user's hair is wrapped around the style bar and then the bar continues to be rolled until the resulting roll reaches the person's scalp. The loose ends of the generally rectangular member comprise left and right wrap ties and are then used to secure the apparatus to the user's head.

The apparatus can be made from any of a number of materials; in one embodiment, cotton interlock fabric is used as it remains breathable and is somewhat stretchy. In another embodiment, a small percentage of polyester is incorporated in the fabric. In yet other embodiments, other types of fabric or materials (the terms fabric and cloth are used interchangeably herein) can be used. The fabric may have a finished and sewn edge; for example, a rolled hem can be incorporated around the perimeter of the apparatus. When laid out flat, the apparatus is preferably about 16.25 inches from the end of one protection flap to the other and approximately 12.75 inches from the top edge to the base. Where the style bar is attached horizontally across (parallel to the base), the apparatus is approximately 7 inches wide, in one embodiment. It is preferable for the "points" of the triangle that comprises the apparatus to be rounded-off significantly.

Many hair styles are achieved with heat styling—blow dryers for body, curling irons and hot rollers for curls. Heat is very damaging to the hair and over time leaves hair dull, dry and lifeless. The apparatus disclosed herein requires no heat, it is one piece, simple to use and can be carried in a pocket for easy travel. Ornamentally, it looks like the user is wearing his or her hair in a stylish bun but all the while it is giving their hair a body and curl that is obvious once the apparatus is removed and the hair is let down. One of the significant advantages to the apparatus is that a person looks good wearing the apparatus, and also has stylish, curled hair with body once the apparatus is removed. Motorcycle and bike helmets leave hair flat and limp but the apparatus can also be worn under a helmet and is great for any sport enthusiast with long hair. The hair protection, retention, and styling apparatus can also be employed throughout the hair and beauty industry, as a dance and gymnastics accessory, for motorcyclists, bicyclists, and to provide for quick and easy hairstyling for children.

Referring now to the drawings, FIG. 1 illustrates a top perspective view of an exemplary embodiment of a hair protection, retention and styling apparatus 10. The apparatus comprises a number of components, including: a first hair protection flap 20, a second hair protection flap 30, a hair retention channel roll 80, a top hair retention flap 40, a first wrap tie 50, a second wrap tie 60, and a hair retention style bar 70.

The main body member of the apparatus 10 is the hair retention channel roll 80. As shown in FIG. 1, the channel roll 80 is placed out flat on a surface and comprises a generally rectangular portion of fabric, cloth, or other functionally similar material. The channel roll 80 forms the primary surface upon which a user of the apparatus 10 places his or her hair during the process of putting in the hair protection, retention and styling apparatus 10. See FIGS. 7-9 for depictions of the hair placed onto the channel roll 80.

The top hair retention flap 40 extends from the top of the channel roll 80. A user's hair should be placed onto the channel roll 80, with the hair ends not quite reaching the top edge of the top hair retention flap 40. The top hair retention flap 40 functions to assist the user in rolling the ends of his or her hair around the style bar 70.

The style bar 70 is attached to either side of the apparatus 10, leaving a hair insertion gap (not shown in FIG. 1, see FIG. 3, item 78) between the style bar 70 and the top portion of the channel roll 80. The style bar comprises a generally round-in-cross-section (see FIG. 4, item 70) bar around which the apparatus, and the user's hair, is rolled. In one embodiment, the style bar 70 is a soft, padded bar comprising quilt batting wrapped in fabric; in other embodiments, a more rigid material such as a foam cylinder comprises the interior of the style bar 70.

Extending from either side of the style bar 70 are the first wrap tie 50 and the second wrap tie 60. The first and second ties 50 and 60 can be a part of the style bar 70; in this embodiment, a single, generally rectangular piece of fabric is placed flat on a surface and quilt batting is placed in the center thereof. The fabric is then rolled to form a cylindrically shaped style bar 70 having first and second ties 50 and 60 extending out from either side of the style bar 70. The fabric is then attached to both side edges of the channel roll 80, forming the style bar 70 as illustrated in FIG. 1. In other embodiments, the style bar 70 could be created independently of the first and second wrap ties 50 and 60. The wrap ties 50 and 60 are crossed and tied to keep the hair protection, retention and styling apparatus attached to the user once properly in place.

Extending from either side of the hair retention channel roll 80 are the first hair protection flap 20 and the second hair protection flap 30. The flaps are generally triangular in shape, beginning near the top of the channel roll 80 and extending down to the base of the channel roll 80. They are designed to fold inwards, on top of the user's hair. See FIG. 10 for a depiction of this process. The hair protection flaps 20 and 30 function to retain the hair within the apparatus 10 during the rolling process and further function to protect a user's hair.

Once a user's hair is properly placed on the channel roll 80 and through the hair insertion gap 78, the hair and the top hair retention flap are then neatly and carefully curled up and over the style bar 70. The user's hair should then be neatly arranged and smoothed on top of the channel roll 80 and the first and second hair protection flaps 20 and 30 can then be folded inwards, over the hair, one over the other (either can end up on top). Once the hair protection flaps 20 and 30 are in place, the rolling process that was started with the hair and top hair retention flap is continued, carefully rolling the hair and the apparatus downwards towards the base of the hair retention channel roll 80. Once the roll reaches the user's scalp, it should be snug neatly up one more time. The ends of the roll should then be brought around to meet one another (either both to the front, or both to the back), thereby forming the classic bun shape. The wrap ties 50 and 60 can then be crossed and pulled tight (but not too tightly or it will leave crush marks on the user's hair). The ties 50 and 60 can be tied or not, but in either case, they should be brought around the bun and secured on the other side when they meet for a second time. Any remaining tie ends can be tucked underneath the bun. Depending on the length of the user's hair, there may be fabric from the apparatus 10 covering the bun. To expose the bun, the fabric is simply pulled down around the base of the bun and tucked in.

Figure 2:
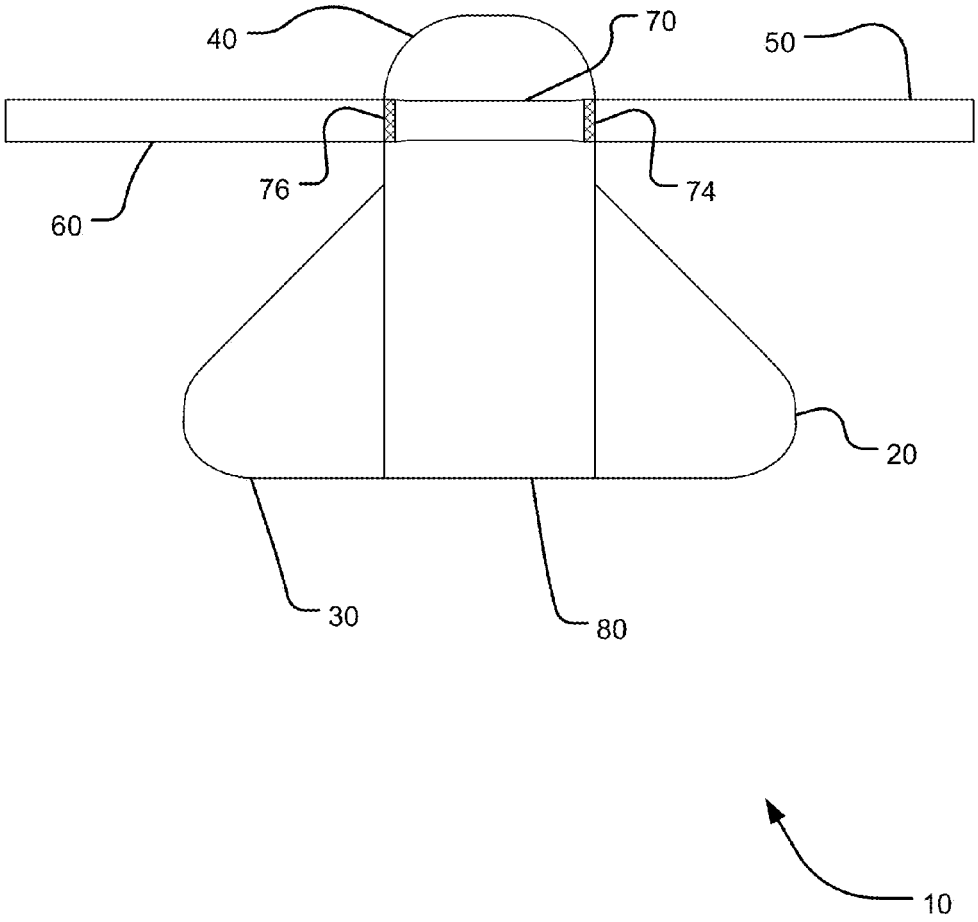
FIG. 2 illustrates a top plan view of an exemplary embodiment of a hair protection, retention and styling apparatus.

FIG. 2 illustrates a top plan view of an exemplary embodiment of a hair protection, retention and styling apparatus 10. The apparatus 10 comprises a number of components, including: a first hair protection flap 20, a second hair protection flap 30, a hair retention channel roll 80, a top hair retention flap 40, a first wrap tie 50, a second wrap tie 60, and a hair retention style bar 70. In the view shown in FIG. 2, first and second attachment points 74 and 76 are shown to illustrate one embodiment of how the style bar 70 and wrap ties 50 and 60 can be attached to the channel roll 80. In another embodiment, the attachment points 74 and 76 are further up onto the top hair retention flap 40. In yet another embodiment, the attachment points 74 and 76 can be placed further down the channel roll 80.

The primary body components of the apparatus 10 shown in FIG. 2 are the first hair protection flap 20, the second hair protection flap 30, the hair retention channel roll 80 and the top hair retention flap 40. All of these components can be formed from a single piece of material or fabric that is cut and shaped correctly as shown in FIG. 2. The relatively long, generally rectangular member can also be formed from a single piece of fabric, as described above. The quilt batting, foam, or other material that is placed within the member before forming it into a cylinder can be as described above or can comprise any other suitable material. The ends of the wrap ties 50 and 60 do not have to be rectangular in shape as shown in FIG. 2, but can comprise any other suitable shape in other embodiments. Although it is preferable for the corners of the generally triangular shape of the apparatus to be rounded as shown in FIG. 2, they can be more or less rounded, pointed, jagged, etc. without departing from the scope of the invention.

Figure 3:
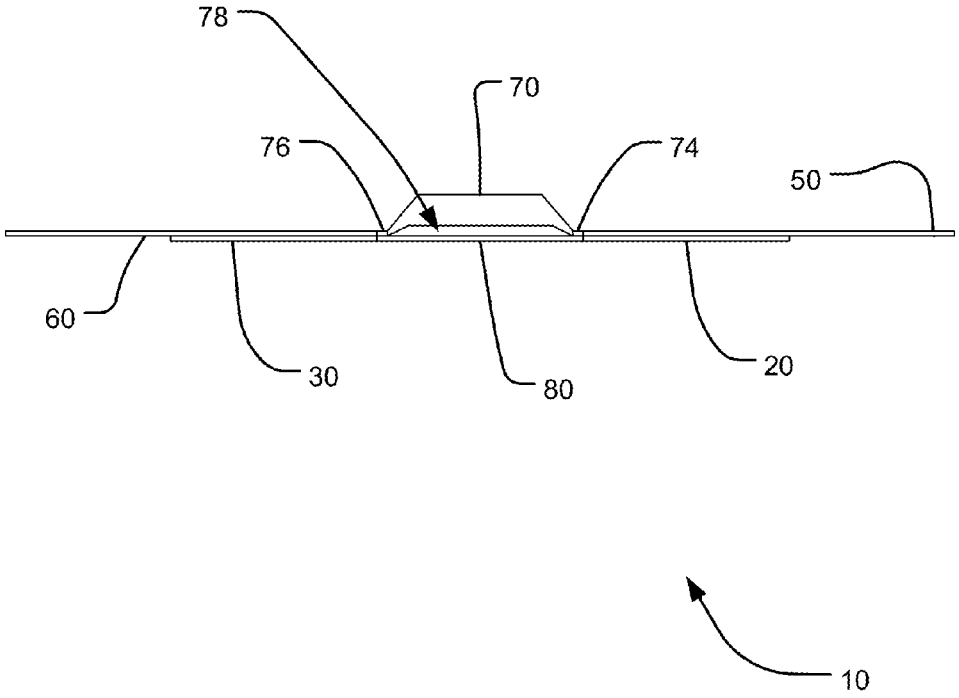
FIG. 3 illustrates a bottom elevation view of an exemplary embodiment of a hair protection, retention and styling apparatus.

FIG. 3 illustrates a bottom elevation view of an exemplary embodiment of a hair protection, retention and styling apparatus 10. The apparatus 10 incorporates a number of components that can comprise thin fabric or similar material. In order to illustrate such components from an elevational side perspective, said components may be shown fatter or thinner than preferred. For examples, in FIG. 3, reference the heights of the first and second hair protection flaps 20 and 30, the hair retention channel roll 80, and the first and second wrap ties 50 and 60. This view highlights the three-dimensional characteristics of the hair retention style bar 70 and its general location above the other components.

In the view shown in FIG. 3, first and second attachment points 74 and 76 are shown to illustrate one embodiment of how the style bar 70 and wrap ties 50 and 60 can be attached to the channel roll 80. In this embodiment, the attachment points 74 and 76 can be sewing, glue, or any other suitable attachment means. The hair insertion gap 78 is left between the style bar 70 and the channel roll 80 of the apparatus 10. A user's hair is inserted through this gap before being rolled onto the style bar 70.

Figure 4:
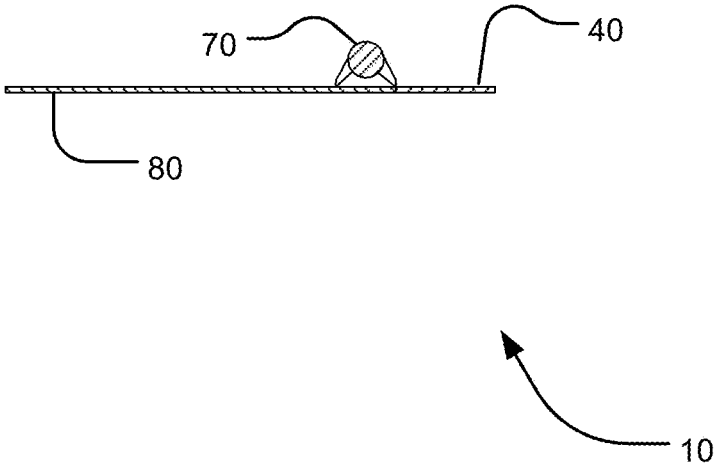
FIG. 4 illustrates a right side elevation view in cross-section of an exemplary embodiment of a hair protection, retention and styling apparatus highlighting the rounded shape of the body bar.

FIG. 4 illustrates a right side elevation view in cross-section of an exemplary embodiment of a hair protection, retention and styling apparatus highlighting the rounded shape of the body bar 10. The apparatus 10 incorporates a number of components that can comprise thin fabric or similar material. In order to illustrate such components from an elevational side perspective, said components may be shown fatter or thinner than preferred. For examples, in FIG. 4, reference the heights of the top hair retention flap 40, and the hair retention channel roll 80. This view highlights the three-dimensional characteristics of the hair retention style bar 70 and its general location above the other components. Since FIG. 4 is a cross-sectional view, the generally cylindrical shape of the style bar 70 is apparent. The style bar 70 is what the user's hair is ultimately wrapped around, and the size and shape of the style bar 70 directly affect the size and shape of the curls and/or body that is imparted to the user's hair by the apparatus 10.

Figure 5:
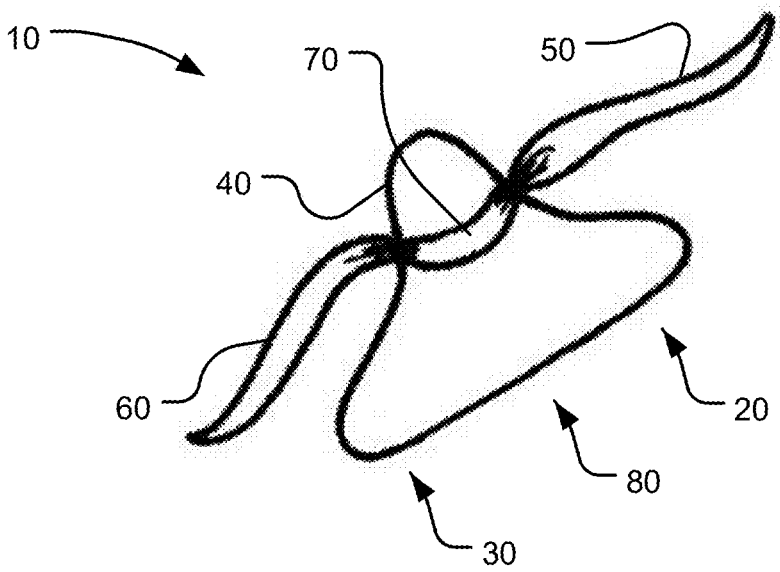
FIG. 5 illustrates a top perspective view of an exemplary embodiment of a hair protection, retention and styling apparatus.

FIG. 5 illustrates a top perspective view of an exemplary embodiment of a hair protection, retention and styling apparatus 10. The figure illustrates a number of components, including: a first hair protection flap 20, a second hair protection flap 30, a hair retention channel roll 80, a top hair retention flap 40, a first wrap tie 50, a second wrap tie 60, and a hair retention style bar 70.

Figure 6:
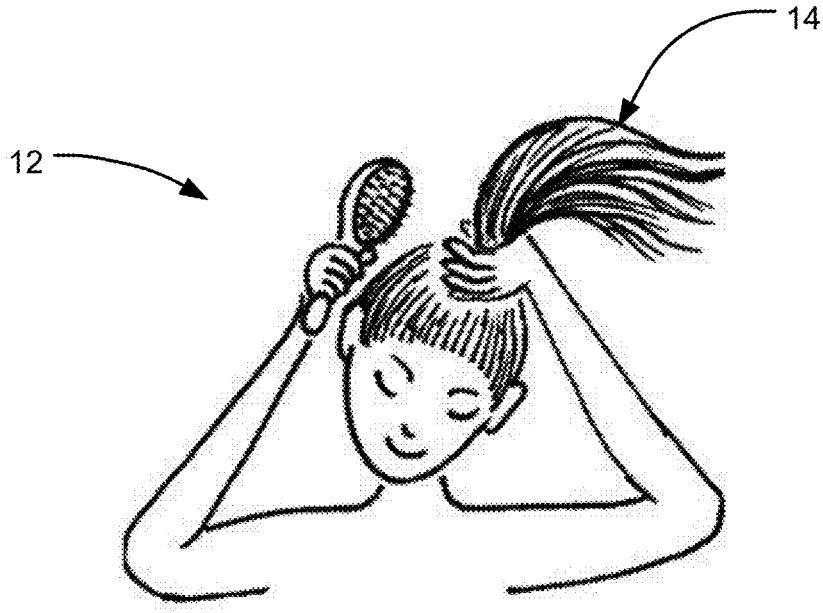
FIG. 6 illustrates a front elevation view of a person preparing her hair before using a hair protection, retention and styling apparatus.

FIG. 6 illustrates a front elevation view of a person 12 preparing her hair 14 before using a hair protection, retention and styling apparatus. This step is accomplished by the user (or a helper) holding the hair with one hand and pulling it up away from the scalp as if making a pony tail. The hair is not secured with an elastic or in any other way.

Figure 7:
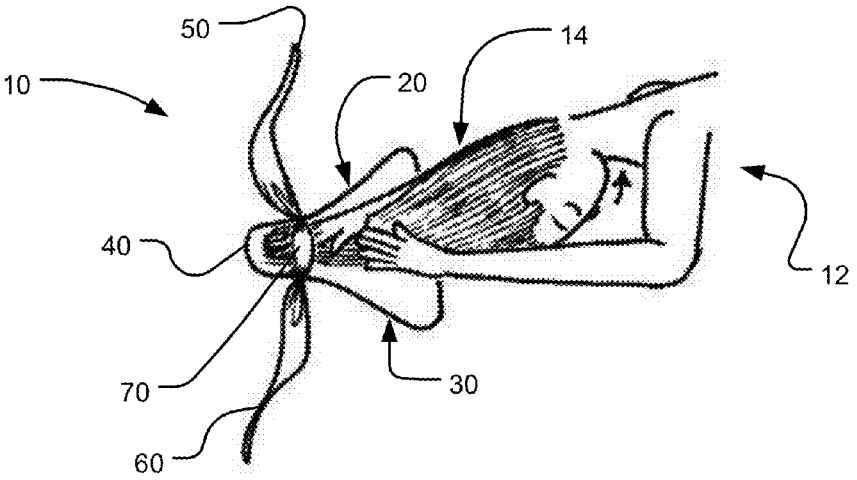
FIG. 7 illustrates a side perspective view of a person initially placing her hair onto a hair protection, retention and styling apparatus.

FIG. 7 illustrates a side perspective view of a person 12 initially placing her hair 14 onto a hair protection, retention and styling apparatus 10. The person 12 lays her hair 14 horizontally onto the apparatus 10, approximately on top of the hair retention channel roll 80 (see other FIGS.). She then inserts the ends of her hair under the style bar 70 via the hair insertion gap (not shown in FIG. 7, see FIG. 3, item 78). The wrap ties 50 and 60, top hair retention flap 40 and first and second hair protection flaps 20 and 30 are also illustrated in FIG. 7.

Figure 8A:
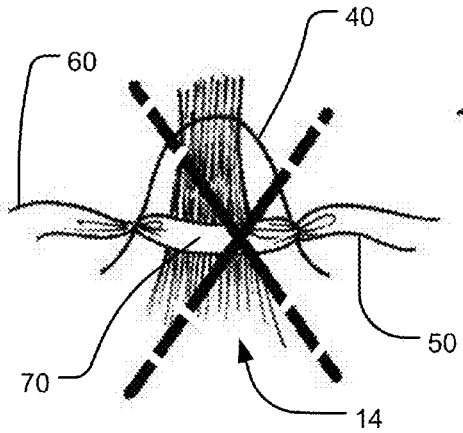
FIG. 8A illustrates a top plan view of a person initially placing her hair incorrectly onto a hair protection, retention and styling apparatus.

FIG. 8A illustrates a top plan view of a person initially placing her hair 14 incorrectly onto a hair protection, retention and styling apparatus. The hair 14 is illustrated in FIG. 8A as extending past the top edge of the top hair retention flap 40. This is incorrect; hence, the large, broken-line "X" through FIG. 8A. For correct usage, see FIG. 8B.

Figure 8B:
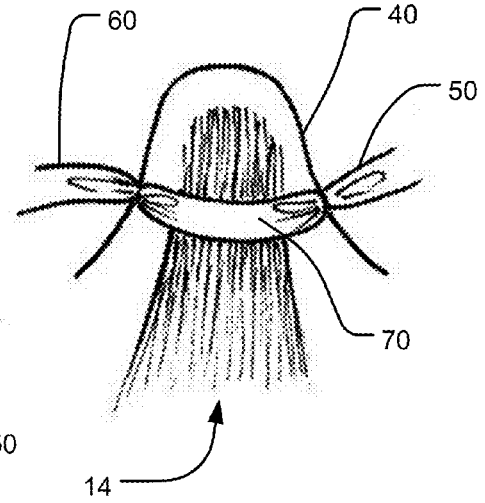
FIG. 8B illustrates a top plan view of a person initially placing her hair correctly onto a hair protection, retention and styling apparatus.

FIG. 8B illustrates a top plan view of a person initially placing her hair 14 correctly onto a hair protection, retention and styling apparatus. Note that the hair 14 does not extend over the top edge of the top hair retention flap 40. Also, the hair is positioned correctly between the style bar 70 and the hair retention channel roll.

Figure 9:
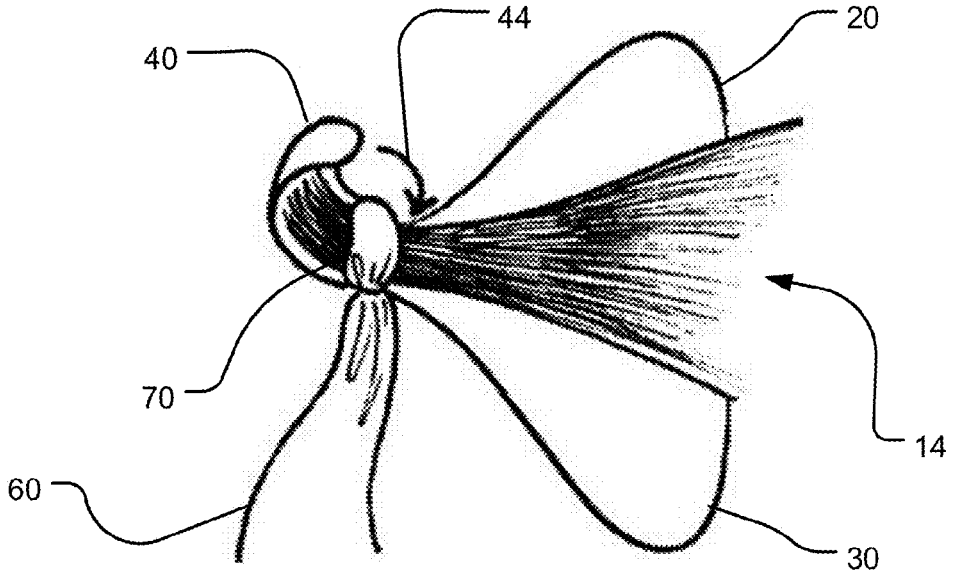
FIG. 9 illustrates a close-up top perspective view of a person beginning the initial retention roll of her hair onto the styling bar of a hair protection, retention and styling apparatus.

FIG. 9 illustrates a close-up top perspective view of a person beginning the initial retention roll of her hair 14 onto the styling bar 70 of a hair protection, retention and styling apparatus. The top hair retention flap 40 and the hair ends are rolled in the direction of the initial retention roll arrow 44, over the style bar 70. Note that the other components illustrated, including the wrap ties and protection flaps (50, 20, and 30) are not utilized yet in the rolling process. In this step, the user's hair tips/ends and the retention flap 40 are pulled up and over the style bar, taking care to curl them neatly around the style bar 70.

Figure 10:
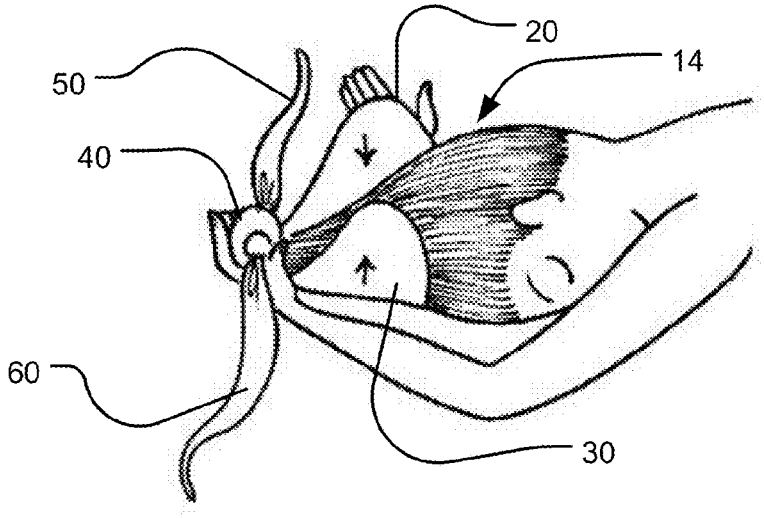
FIG. 10 illustrates a side perspective view of a person folding in the first and second protection flaps of a hair protection, retention and styling apparatus.

FIG. 10 illustrates a side perspective view of a person folding in the first and second protection flaps 20 and 30 of a hair protection, retention and styling apparatus. In this step, it is important that the user's hair be smoothed neatly between the flaps 20 and 30 and then the flaps 20 and 30 are carefully folded over the top of the hair—one flap being folded over the other (either 20 or 30 can end up on top). The roll that is developing under the top hair retention flap 40 should be continued once the flaps 20 and 30 are in place, continuing towards the user's scalp.

Figure 11:
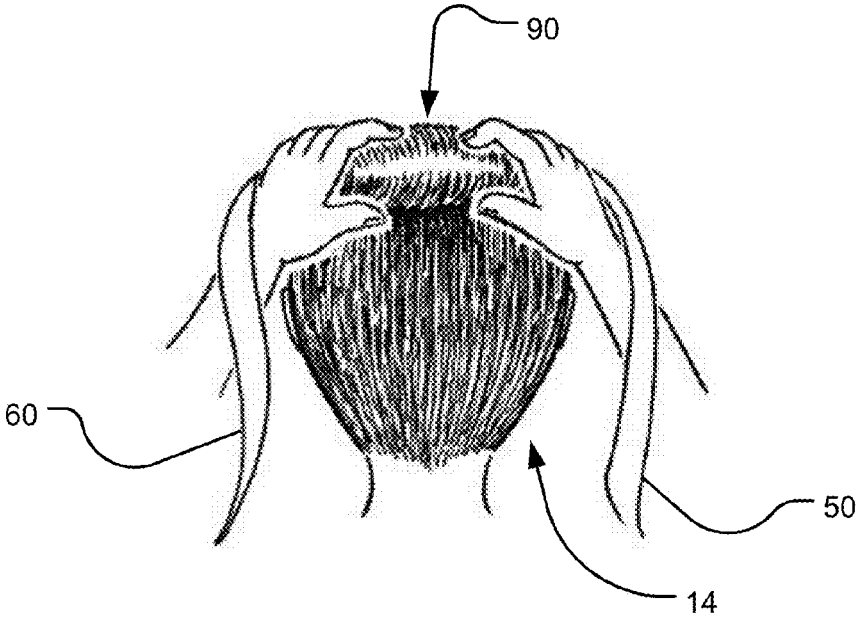
FIG. 11 illustrates a back perspective view of a person finishing the rolling process of putting in a hair protection, retention and styling apparatus.

FIG. 11 illustrates a back perspective view of a person finishing the rolling process of putting in a hair protection, retention and styling apparatus. The hair roll 90 now contains the entire apparatus (except the trailing wrap ends 50 and 60) and much of the user's hair 14.

Figure 12:
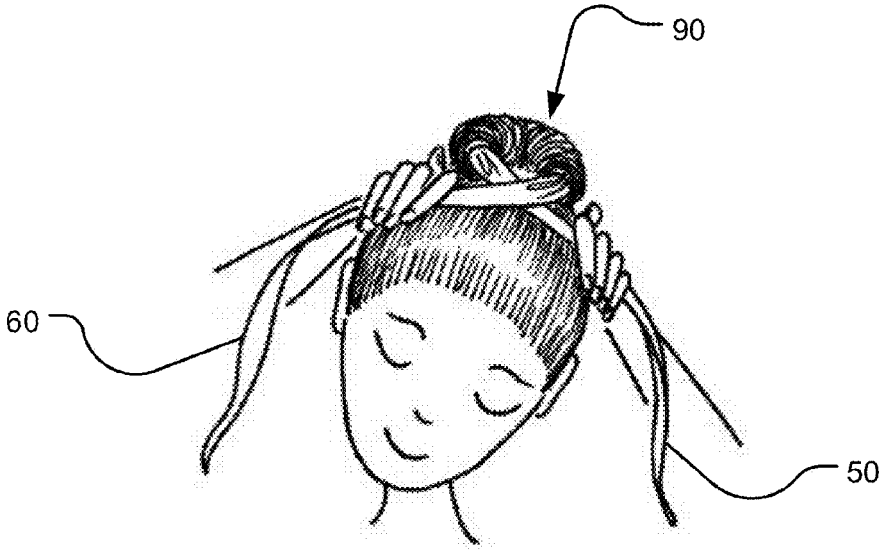
FIG. 12 illustrates a front perspective view of a person bending the ends around in front and crossing the wrap ties of a hair protection, retention and styling apparatus.

FIG. 12 illustrates a front perspective view of a person bending the ends of the roll 90 around in front and crossing the wrap ties 50 and 60 of a hair protection, retention and styling apparatus. By bending the ends of the roll 90, the user creates a curl, coil, or bun on his or her head. By crossing the wrap ties 50 and 60, the user begins the process of securing the apparatus and bun on his or her head.

Figure 13:
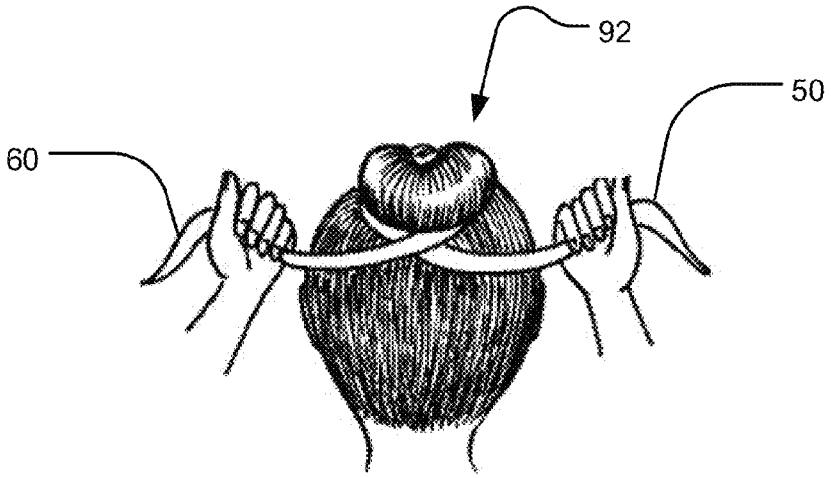
FIG. 13 illustrates a back perspective view of a person bringing the wrap ties around the back and crossing the wrap ties of a hair protection, retention and styling apparatus.

FIG. 13 illustrates a back perspective view of a person bringing the wrap ties 50 and 60 around the back and crossing the wrap ties of a hair protection, retention and styling apparatus. By crossing the wrap ties 50 and 60 a second time, the user helps to further secure the apparatus and the bun 92. The ties 50 and 60 could be tied off and tucked in at this point, in one embodiment.

Figure 14:
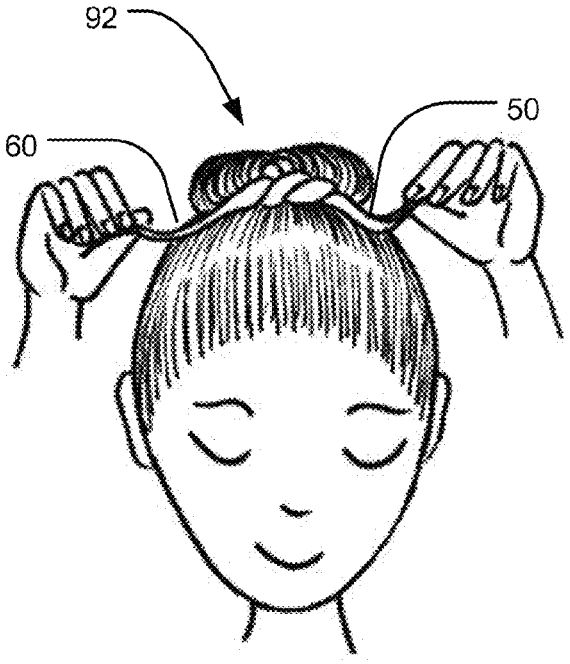
FIG. 14 illustrates a front perspective view of a person tying the wrap ties around the front and finishing the process of putting in a hair protection, retention and styling apparatus.

FIG. 14 illustrates a front perspective view of a person tying the wrap ties 50 and 60 around the front and finishing the process of putting in a hair protection, retention and styling apparatus to form a bun 92.

While particular embodiments have been described and disclosed in the present application, it is clear that any number of permutations, modifications, or embodiments may be made without departing from the spirit and the scope of this disclosure.

Particular terminology used when describing certain features or aspects of the embodiments should not be taken to imply that the terminology is being redefined herein to be restricted to any specific characteristics, features, or aspects with which that terminology is associated. In general, the terms used in the following claims should not be construed to be limited to the specific embodiments disclosed in the specification, unless the above Detailed Description section explicitly defines such terms. Accordingly, the actual scope of the claims encompasses not only the disclosed embodiments, but also all equivalent ways of practicing or implementing the claimed subject matter.

The above detailed description of the embodiments is not intended to be exhaustive or to limit the disclosure to the precise embodiment or form disclosed herein or to the particular fields of usage mentioned above. While specific embodiments and examples are described above for illustrative purposes, various equivalent modifications are possible within the scope of the disclosure, as those skilled in the relevant art will recognize. Also, the teachings of the embodiments provided herein can be applied to other systems, not necessarily the system described above. The elements and acts of the various embodiments described above can be combined to provide further embodiments.

Any patents, applications and other references that may be listed in accompanying or subsequent filing papers, are incorporated herein by reference. Aspects of embodiments can be modified, if necessary, to employ the systems, functions, and concepts of the various references to provide yet further embodiments.

In light of the above "Detailed Description," the Inventor may make changes to the disclosure. While the detailed description outlines possible embodiments and discloses the best mode contemplated, no matter how detailed the above appears in text, embodiments may be practiced in a myriad of ways. Thus, implementation details may vary considerably while still being encompassed by the spirit of the embodiments as disclosed by the inventor. As discussed herein, specific terminology used when describing certain features or aspects should not be taken to imply that the terminology is being redefined herein to be restricted to any specific characteristics, features, or aspects of the embodiments with which that terminology is associated.

While certain aspects are presented below in certain claim forms, the inventor contemplates the various aspects in any number of claim forms. Accordingly, the inventor reserves the right to add additional claims after filing the application to pursue such additional claim forms for other aspects.

The above specification, examples and data provide a description of the structure and use of exemplary implementations of the described systems, articles of manufacture and methods. It is important to note that many implementations can be made without departing from the spirit and scope of the disclosure.

What is claimed is:

1. A hair protection, retention, and styling apparatus, comprising:

a plurality of hair flaps, including at least a first hair protection flap, a second hair protection flap, and a top hair retention flap;

a hair retention channel roll having a generally rectangular shape with a top side, a left side, a right side, and a base side forming a perimeter of the hair retention channel roll and defining a top surface and a rear surface therebetween, and wherein the first hair protection flap extends outwards from the right side of the hair retention channel roll, and the second hair protection flap extends outwards from the left side of the hair retention channel roll, and the top hair retention flap extends from the top side of the hair retention channel roll, the plurality of hair flaps thereby arranged on the hair retention channel roll so as together to form a generally triangular shape;

a first wrap tie and a second wrap tie;

the first wrap tie attaching to a right side of the hair protection, retention and styling apparatus;

the second wrap tie attaching to a left side of the hair protection, retention and styling apparatus; and a hair retention style bar having a first attachment end and a second attachment end and wherein the first attachment end is attached to the juncture of the top hair retention flap and the top side of the hair retention channel roll and approximately along the right side of the hair retention channel roll at a first attachment point, and the second attachment end is attached to the juncture of the top hair retention flap and the top side of the hair retention channel roll and approximately along the left side of the hair retention channel roll at a second attachment point, the hair retention style bar extending above and across the top surface of the hair retention channel roll thereby creating a hair insertion gap between the style bar and the top surface of the channel roll between the first attachment point and the second attachment point within which a user places the user's hair.

2. The hair protection, retention, and styling apparatus of claim 1, wherein the hair retention channel roll comprises a portion of fabric.

3. The hair protection, retention, and styling apparatus of claim 1, wherein the plurality of hair protection flaps comprises a portion of fabric.

4. The hair protection, retention, and styling apparatus of claim 1, wherein the style bar comprises a generally round-in-cross-section bar around which the top hair retention flap and the ends of the user's hair can be rolled.

5. The hair protection, retention, and styling apparatus of claim 2, wherein the style bar comprises a generally round-in-cross-section bar around which the top hair retention flap and the ends of the user's hair can be rolled.

6. The hair protection, retention, and styling apparatus of claim 3, wherein the style bar comprises a generally round-in-cross-section bar around which the top hair retention flap and the ends of the user's hair can be rolled.

7. The hair protection, retention, and styling apparatus of claim 4, wherein the bar comprises a soft, quilt batting wrapped in fabric.

8. The hair protection, retention, and styling apparatus of claim 5, wherein the bar comprises a soft, quilt batting wrapped in fabric.

9. The hair protection, retention, and styling apparatus of claim 6, wherein the bar comprises a soft, quilt batting wrapped in fabric.

10. The hair protection, retention, and styling apparatus of claim 1, wherein the first wrap tie attaches to the first attachment point and extends outwards therefrom and the second wrap tie attaches to the second attachment point and extends outwards therefrom.

11. The hair protection, retention, and styling apparatus of claim 4, wherein the first wrap tie attaches to the first attachment point and extends outwards therefrom and the second wrap tie attaches to the second attachment point and extends outwards therefrom.

12. The hair protection, retention, and styling apparatus of claim 7, wherein the first wrap tie attaches to the first attachment point and extends outwards therefrom and the second wrap tie attaches to the second attachment point and extends outwards therefrom.

13. A method of using a hair protection, retention, and styling apparatus, the apparatus comprising:

a plurality of hair flaps, including at least a first hair protection flap, a second hair protection flap, and a top hair retention flap;

a hair retention channel roll having a generally rectangular shape with a top side, a left side, a right side, and a base side forming a perimeter of the hair retention channel roll and defining a top surface and a rear surface therebetween, and wherein the first hair protection flap extends outwards from the right side of the hair retention channel roll, and the second hair protection flap extends outwards from the left side of the hair retention channel roll, and the top hair retention flap extends from the top side of the hair retention channel roll, the plurality of hair protection flaps thereby arranged on the hair retention channel roll so as together to form a generally triangular shape;

a first wrap tie and a second wrap tie;

the first wrap tie attaching to a right side of the hair protection, retention and styling apparatus;

the second wrap tie attaching to a left side of the hair protection, retention and styling apparatus; and a hair retention style bar having a first attachment end and a second attachment end and wherein the first attachment end is attached to the juncture of the top hair retention flap and the top side of the hair retention channel roll and approximately along the right side of the hair retention channel roll at a first attachment point, and the second attachment end is attached to the juncture of the top hair retention flap and the top side of the hair retention channel roll and approximately along the left side of the hair retention channel roll at a second attachment point, the hair retention style bar extending above and across the top surface of the hair retention channel roll thereby creating a hair insertion gap between the style bar and the top surface of the channel roll between the first attachment point and the second attachment point within which a user places the user's hair;

and wherein the method comprises:

placing the user's hair on the channel roll;

inserting the ends of the user's hair through the hair insertion gap;

curling up the hair and the top hair retention flap over the style bar;

arranging the hair on the top surface of the channel roll;

folding the first hair protection flap inwards, over the hair;

folding the second hair protection flap inwards, over the hair;

rolling the hair, top hair retention flap and style bar over the first and second hair protection flaps and downwards towards the base side of the hair retention channel roll;

grasping each end of a resulting hair roll and bringing the ends of the roll around to meet each other and form a bun;

crossing and tying the first wrap tie and the second wrap tie to secure the apparatus in the user's hair.

14. The method of claim 13, further comprising: securing any portions of the first tie wrap and second tie wrap that extend from the bun by tucking under the bun.

15. The method of claim 13, further comprising: securing any portion of the plurality of hair retention flaps that extends over the bun by tucking under the bun.

16. The method of claim 14, further comprising: securing any portion of the plurality of hair retention flaps that extends over the bun by tucking under the bun.

* * * * *